US006516775B2

(12) United States Patent
Cornell et al.

(10) Patent No.: US 6,516,775 B2
(45) Date of Patent: Feb. 11, 2003

(54) COMPRESSION BRAKE ACTUATION SYSTEM AND METHOD

(75) Inventors: Sean O. Cornell, Pontiac, IL (US); Steven J. Funke, Princeville, IL (US); Scott A. Leman, Eureka, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/742,730

(22) Filed: Dec. 20, 2000

(65) Prior Publication Data

US 2002/0073959 A1 Jun. 20, 2002

(51) Int. Cl.[7] ..... F02D 13/04
(52) U.S. Cl. ..... 123/321
(58) Field of Search ..... 123/320, 321, 123/322, 323, 90.12, 90.13

(56) References Cited

U.S. PATENT DOCUMENTS 5,163,389 A * 11/1992 Fujikawa et al. ..... 123/321
5,724,939 A 3/1998 Faletti et al.
6,273,057 B1 * 8/2001 Schwoerer et al. ..... 123/321
6,325,043 B1 * 12/2001 Meistrick et al. ..... 123/321
6,334,429 B1 * 1/2002 Little, Jr. ..... 123/321

* cited by examiner

*Primary Examiner*—Willis R. Wolfe
(74) *Attorney, Agent, or Firm*—Keith P Roberson

(57) ABSTRACT

Compression brake systems using "back-fill" between combustion cylinders or requiring an exhaust valve to be opened twice during a braking cycle require brake actuation systems able to maintain control over the exhaust valve during different loading conditions. In a first opening event where a piston is at or near bottom dead center, pressures in the combustion cylinder are low. During a second opening event near top dead center pressures are higher. Movement of the exhaust valve may be slowed during the first opening event by controlling fluid leaving a second actuator volume opposite a first actuator volume providing opening force on an exhaust valve.

13 Claims, 2 Drawing Sheets

COMPRESSION BRAKE ACTUATION SYSTEM AND METHOD

TECHNICAL FIELD

The present invention relates generally to an engine retarding device for an internal combustion engine and more particularly to a method and system for compression brake actuation.

BACKGROUND ART

Compression brakes or engine retarders are used to assist and supplement wheel brakes in slowing heavy vehicles, such as tractor-trailers. Compression brakes are desirable because they help alleviate wheel brake overheating. As vehicle design and technology have advanced, hauling capacity of tractor-trailers has increased, while at the same time rolling resistance and wind resistance have decreased. Thus, there is a need for advanced engine braking systems in today's heavy vehicles.

Known engine compression brakes convert an internal combustion engine from a power generating unit into a power consuming air compressor. Typically, an exhaust valve located in a combustion cylinder opens when a piston in the cylinder nears a top dead center (TDC) position on a compression stroke.

In an effort to maximize braking power, some systems open the exhaust valve of each cylinder during a first opening event and a second opening event. In this manner, pressure released from a first cylinder into the exhaust manifold is used to boost the pressure of a second cylinder. Thereafter, the pressure in the second cylinder is further increased during the upstroke of the associated piston so that retarding forces are similarly increased. This mode of operation is termed "back-filling" and is disclosed in U.S. Pat. No. 5,724,939 issued to Faletti et al on Mar. 10, 1998.

Systems employing "back-filling" may require opening the exhaust valves twice during the compression or exhaust cycles. During a first opening event, the piston is at or near bottom dead center (BDC). During a second opening event, the piston is at or near TDC and pressures in the cylinder typically are higher than pressures in the cylinder during the first opening event. Forces required to move the exhaust valve during the second opening event are greater than those in the first opening event. Systems are typically designed to meet the higher opening forces required in the second opening event. Operating the exhaust valve with these higher opening forces may cause an exhaust valve actuating device to impact the exhaust valve or loose contact with exhaust valve during when acting against the lower opening forces present in the first opening event. Loosing contact between the exhaust valve and valve actuating device or "overshoot" reduces controllability of the valve opening events. Further, impact between the exhaust valve and valve actuating device may cause premature wear of both the valve actuating device and the valve.

The present invention is directed to overcoming one or more of the problems as set forth above.

DISCLOSURE OF THE INVENTION

In one aspect of the present invention a compression brake actuation device for an internal combustion engine has a brake actuator cylinder with a brake actuator piston. The brake actuator piston has a first actuating surface and a second actuating surface. The brake actuator cylinder and the first actuating surface define a first actuator volume. The brake actuator cylinder and the second actuating surface define a second actuator volume. A first fluid conduit is in fluid communication with the first actuator volume. The second fluid conduit is in fluid communication with the second actuator volume.

In another aspect of the present invention a method of operating a compression brake actuation system discloses pressurizing a first actuator volume. Fluid is controllably drained from a second volume. A brake actuator moves the brake actuator piston in response to the pressurizing and draining steps.

BEST MODE FOR CARRYING OUT THE INVENTION

Figure 1:
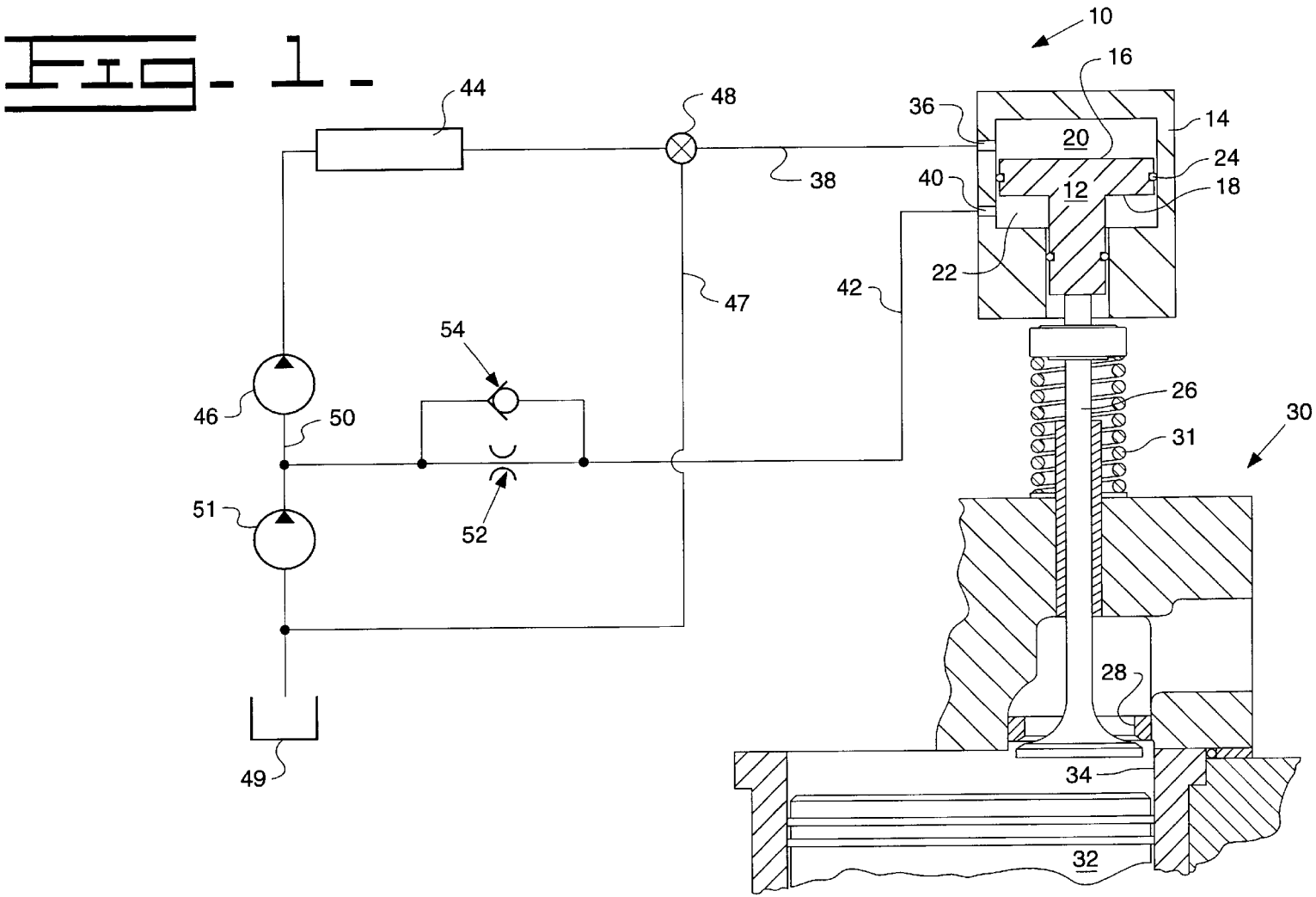
FIG. 1 is a sketch of a compression brake system incorporating the method of the present invention.

In FIG. 1 a compression brake system 10 is shown having a brake actuator piston 12 and a brake actuator cylinder 14. The brake actuator piston 12 is slidably positioned in the actuator cylinder 14. The brake actuator piston 12 has a first actuating surface 16 and a second actuating surface 18 opposite one another. The first actuating surface 16 and brake actuator cylinder 14 define a first actuator volume 20. The second actuating surface 18 and the brake actuator cylinder 14 define a second actuator volume 22. A seal 24 of any conventional design connects between the brake actuator piston 12 and the actuator cylinder 14. The seal 24 also separates the first actuator volume 20 from the second actuator volume 22. The brake actuator piston connects with a valve 26 positioned in a port 28 of an internal combustion engine 30. In this application the valve 26 is an exhaust valve positioned in an exhaust port. A valve spring 31 connects between the engine 30 and valve 26. The engine 30 may be of any conventional design having a piston 32 moving within a combustion cylinder 34.

The brake actuator cylinder 14 also has a first fluid port 36 positioned to allow fluid to pass from a first fluid conduit 38 into the first actuator volume 20 and a second fluid port 40 positioned to allow fluid to pass from a second fluid conduit 42 into the second actuator volume 22. In this embodiment, the first fluid conduit 38 connects to a fluid manifold 44 in this application a hydraulic oil rail being fed by a first oil pump 46. Preferably the first oil pump 46 will have variable flow rates and an internal pressure regulator as described in U.S. Pat. No. 5,515,829 issued to Wear et al on May 14, 1996. Other fluids such as water, fuel, or air may also be used. A control valve 48 is positioned in the first fluid conduit 38 intermediate the fluid manifold 44 and the first actuator volume 20. Any conventional valve may be used such as electronic, mechanical, hydraulic, or piezoelectric valves. For this embodiment, the control valve 48 is a electro-hydraulically actuated valve such as the upper portion of the hydraulically actuated, electronically controlled unit injector as shown in U.S. Pat. 6,014,956 issued to Cowden et al on Jan. 18, 2000. The control valve 48 also connects with a drain line 47 to return fluid to a sump 51. In this application, the fluid manifold 44 and first oil pump 46 also supply control fluid to a hydraulically actuated fuel system (not shown).

The second fluid conduit 42 in this embodiment receives fluid from a fluid feed line 50 connected between a second oil pump 49 and the first oil pump 46. The second oil pump 49 connects to the sump 51. An orifice 52 or similar flow restriction is positioned in the second fluid conduit 42 intermediate the fluid feed line 50 and the second actuator volume 22. Optionally, the orifice 52 may include a check valve 54 or orifice by-pass allowing fluid to by-pass the orifice when flowing from the fluid feed line 50 to the second actuator volume 22.

Figure 2:
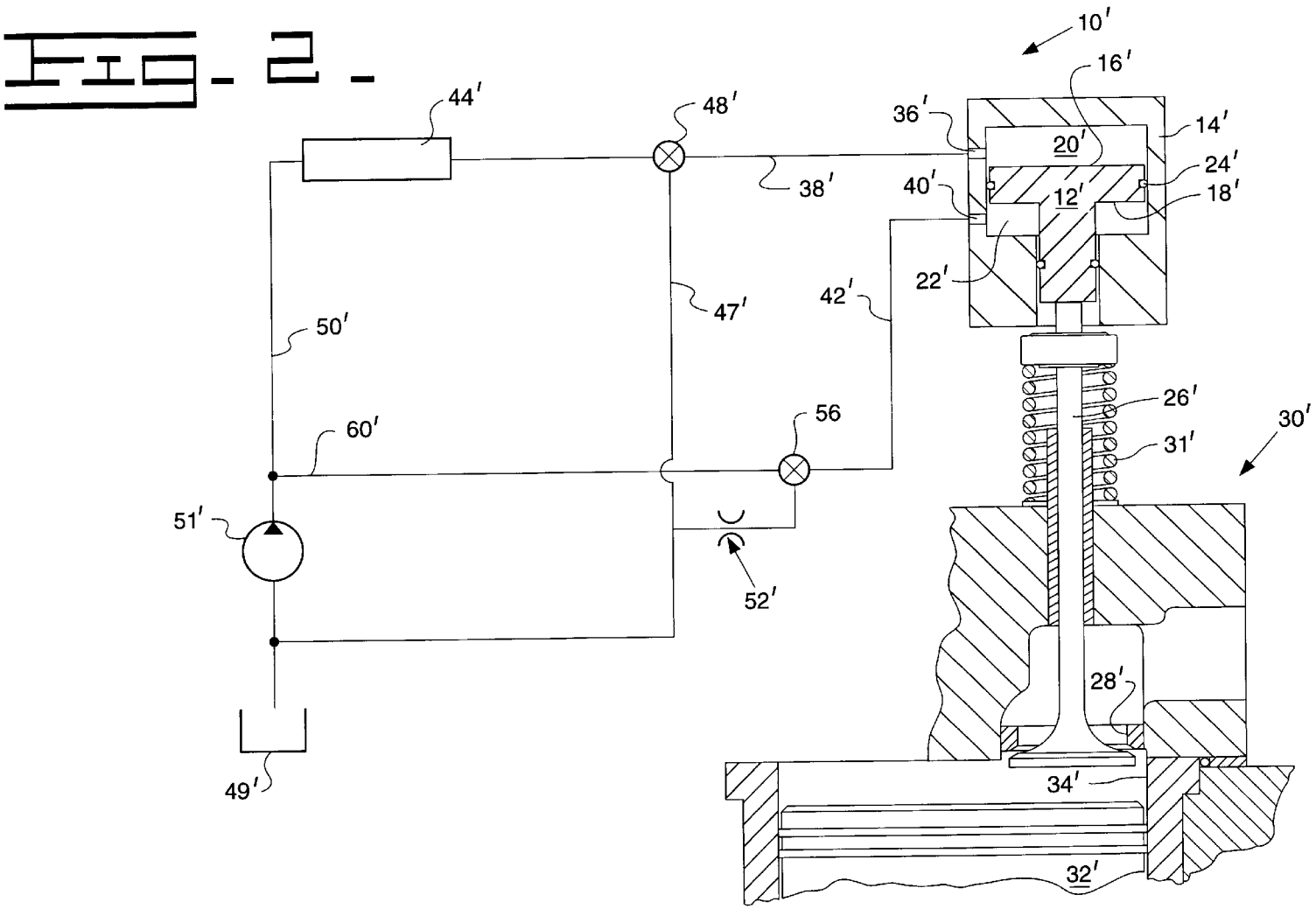
FIG. 2 is a sketch showing an alternative embodiment of the compression brake system.

Alternatively, FIG. 2 shows the first oil pump 46' (where "'" shows similar structure as found in FIG.1) supplying the second fluid conduit 42' through a control valve 56 connected to a drain branch 58 and a fill branch 60. The drain branch 58 connects to second control volume through an orifice 52' to the sump 49'. The fill branch connects to the second actuator volume 22 through a pressure regulator 62 or other conventional pressure reduction device to the first oil pump 46'.

INDUSTRIAL APPLICABILITY

The compression brake system 10 of the current invention prevents "overshoot" by allowing fluid in the second actuator volume 22 to reduce speed of the brake actuator piston 12. Reducing "overshoot" improves control of the brake actuation system 10 and reduces wear inherent from the break actuator piston 12 impacting the exhaust valve 26.

During a first opening event, the piston is at or near BDC. Pressures in the combustion cylinder 34 at this time are relatively low. Opening the exhaust valve 26 during the first opening requires sufficient to compress the spring 31. During a second opening event, the piston 32 is at or near top dead center (TDC). Pressure in the combustion cylinder 34 during the second opening event is increased. The opening force for the second event must now overcome both force from the spring 31 along with pressure forces over acting on the valve 26. Fluid in the fluid manifold 44 is generally at a predetermined pressure. The first actuating surface 16 is generally designed to produce sufficient forces, when exposed to fluid pressures in the fluid manifold 44, to open the exhaust valve 26 during the second opening event.

However, the sufficient forces for the second opening event result in overshoot during the first opening event. Restricting fluid flow from the second actuator volume 22 allows fluid to act on the second actuating surface 18 to create additional forces more akin to forces sufficient for the second opening event preventing "overshoot."

To actuate the compression brake system 10, the control valve 48 moves to a first position allowing fluid from the fluid manifold to pass into the first actuator volume 20. As fluid enters the first actuator volume 20, pressure on the first actuating surface 16 moves the brake actuator piston 12 against the valve 26. Fluid in the second actuator volume 22 passes through the second fluid conduit 42 into the lower pressure fluid feed line 50. The flow restriction 52 limits flow from the second actuator volume 22.

To deactivate the compression brake system, the control valve 48 is moved to a second position allowing fluid to exit the first fluid volume 20 through the drain line 47 into a sump 49. Fluid from the feed line now passes through the check valve 54 by-passing the flow restriction 52 to fill the second actuator volume 22. Pressure in the second actuator volume 22 along with force from the spring 26 return the valve 26 to close the port 28.

The alternative in FIG. 2 replaces the second oil pump 51 with a pressure regulator 62. The pressure regulator may be variable or fixed and controlled hydraulically, electronically, mechanically, or by some combination thereof. The control valve 56 is movable between a first and second position. In the first position, the control valve directs fluid from the second actuator volume 22 into the drain branch 58 through the restriction 52 into the sump 49. The second position allows fluid from the first fluid pump 46 to enter the second actuator volume 22 at some predetermined reduced pressure.

Other aspects, objects, and advantages of this invention can be obtained from a study of the drawings, the disclosure, and the appended claims.

What is claimed is:

1. A compression brake actuation device for an internal combustion engine, said compression brake actuating device comprising:

a brake actuator cylinder;

a brake actuator piston positioned in said brake actuator cylinder, said brake actuator piston having a first actuating surface and a second actuating surface, said brake actuator cylinder and said first actuating surface defining a first actuator volume, said brake actuator cylinder and said second actuating surface defining a second actuator volume, said brake actuator piston being adapted to connect with a valve being adapted to restrict a port on an internal combustion engine;

a first fluid conduit in fluid communication with said first actuator volume;

a second fluid conduit in fluid communication with said second actuator volume; and an orifice in said second fluid conduit, said orifice being a flow restriction.

2. The compression brake actuating device as set out in claim 1 further comprising a flow restriction by-pass, said flow restriction by-pass only allowing a by-pass from said second fluid conduit to said second actuator volume.

3. A compression brake system for an internal combustion engine, said compression brake actuation system comprising:

a brake actuator cylinder;

a brake actuator piston positioned in said brake actuator cylinder, said brake actuator piston having a first actuating surface and a second actuating surface, said brake actuator cylinder and said first actuating surface defining a first actuator volume, said brake actuator cylinder and said second actuating surface defining a second actuator volume, said brake actuator piston being adapted to connect with a valve being adapted to restrict a port on an internal combustion engine;

a first fluid conduit in fluid communication with said first actuator volume;

a second fluid conduit in fluid communication with said second actuator volume;

a fluid manifold being connected with said first fluid conduit;

a control valve connected intermediate said fluid manifold and said second actuator volume;

a second fluid source being connected with said second fluid conduit; and an orifice being positioned intermediate said second fluid source and said second actuator volume.

4. The compression brake system as set out in claim 3 further comprising a flow restriction by-pass being adapted to allow fluid to by-pass said orifice from said second fluid source to said second actuator volume.

5. The compression brake actuation system as set out in claim 3 further comprising a hydraulic pump being adapted to supply oil to said fluid manifold.

6. The compression brake actuation system set out in claim 3 wherein said second fluid source being at a lower pressure than said fluid manifold.

7. A method of operating a compression brake actuation system for an internal combustion engine comprising the steps of:

pressurizing a first actuator volume;

controllably draining a second actuator volume through an orifice;

tuning said orifice to restrict flow from said second actuator volume; and moving a brake actuator piston in response to said pressurizing and draining steps.

8. The method as specified in claim 7 wherein said pressurizing step is controlling a valve between a fluid manifold and said first actuator volume.

9. The method of operating as set out in claim 7 wherein said draining step being to a fluid source.

10. The method of operating as set out in claim 9 wherein said fluid source is a sump.

11. A compression brake actuation device for an internal combustion engine, said compression brake actuating device comprising:

a brake actuator cylinder;

a brake actuator piston positioned in said brake actuator cylinder, said brake actuator piston having a first actuating surface and a second actuating surface, said brake actuator cylinder and said first actuating surface defining a first actuator volume, said brake actuator cylinder and said second actuating surface defining a second actuator volume, said brake actuator piston being adapted to connect with a valve being adapted to restrict a port on an internal combustion engine;

a first fluid conduit in fluid communication with said first actuator volume;

a second fluid conduit in fluid communication with said second actuator volume; and a flow restriction said second fluid conduit; and a flow restriction by-pass, said flow restriction by-pass only allowing a by-pass from said second fluid conduit to said second actuator volume.

12. The compression brake actuation device as set out in 11, wherein said flow restriction is an orifice.

13. The compression brake actuation device as set out in 11, wherein said flow restriction by-pass is check valve.

* * * * *